US005111861A

United States Patent [19]

Gore et al.

[11] Patent Number: 5,111,861

[45] Date of Patent: May 12, 1992

[54] APPARATUS FOR CAMBERING WOOD TRUSSES

[75] Inventors: Charles E. Gore, Colleyville; Frank E. Fairley, San Antonio; Edward Hardee, Bedford; Carl T. Medeen, Grapevine, all of Tex.

[73] Assignee: Truswal Systems Corporation, Arlington, Tex.

[21] Appl. No.: 541,476

[22] Filed: Jun. 22, 1990

Related U.S. Application Data

[62] Division of Ser. No. 243,698, Sep. 13, 1988, abandoned.

[51] Int. Cl.[5] ..... B27H 1/00

[52] U.S. Cl. ..... 144/256.1; 29/432; 100/913; 144/2 R; 144/255

[58] Field of Search ..... 227/152; 29/432, 798; 100/35, 41, 144, 153, 155 R, 159, 161, 173, 176, 207, 208, 210; 144/256.1, 256.2, 270, 2 R, 3 R, 255

[56] References Cited

U.S. PATENT DOCUMENTS

| | | | |
|---|---|---|---|
| 3,120,172 | 2/1964 | Enloe | 100/41 |
| 3,212,694 | 10/1965 | Sanford | 100/913 X |
| 3,538,843 | 11/1970 | Lubin . | |
| 3,667,379 | 6/1972 | Templin . | |
| 3,749,391 | 7/1973 | Templin . | |
| 3,868,898 | 3/1975 | Sanford . | |
| 3,903,583 | 9/1975 | Adams | 100/913 X |
| 3,908,259 | 9/1975 | Adams . | |
| 3,925,870 | 12/1975 | Adams . | |
| 3,939,764 | 2/1976 | McCormack . | |
| 4,005,520 | 2/1977 | Sanford | 29/432 |
| 4,084,498 | 4/1978 | Weaver . | |
| 4,089,107 | 5/1978 | Sanford . | |
| 4,154,164 | 5/1979 | Hammond . | |
| 4,341,153 | 7/1982 | Bowser . | |
| 4,627,564 | 12/1986 | Bowser . | |
| 4,672,006 | 6/1987 | McGraw | 100/41 X |

*Primary Examiner*—W. Donald Bray
*Attorney, Agent, or Firm*—W. Kirk McCord

[57] ABSTRACT

A plurality of wood truss members and metal connector plates are assembled on a relatively flat conveyor surface and are transported to a first pressing station having two pairs of pressing rollers for partially embedding the connector plates into the wood members. The truss is then moved to a second pressing station having another pair of pressing rollers, where the plates are substantially completely embedded into the wood members. All of the rollers have substantially the same diameter and preferably have a diameter of at least ten inches to reduce the "rocking action" on the ends of the plates, particularly during the initial stages of the pressing operation. A plurality of guide rails are disposed beneath the conveyor surface for journally supporting the conveyor surface and the truss. At least one of the rails extends substantially beyond the first pressing station to maintain the alignment of the conveyor surface and the truss as they are moved past the first pressing station toward the second pressing station.

11 Claims, 8 Drawing Sheets

APPARATUS FOR CAMBERING WOOD TRUSSES

This application is a division of copending application Ser. No. 07/243,698, filed Sept. 13, 1988, now abandoned.

FIELD OF THE INVENTION

The present invention relates generally to wool trusses used in building construction and in particular to an apparatus and method for fabricating wood trusses.

BACKGROUND OF THE INVENTION

A conventional truss is typically comprised of top and bottom chords, a plurality of web members extending between the top and bottom chords and a plurality of metal toothed connector plates for securing the ends of each web member to the top and bottom chords, thereby completing the fabrication of the truss. It is critical that these metal connector plates be properly positioned and attached to the wood members of the truss in order to provide the necessary structural strength and integrity.

When a floor truss is being fabricated, sufficient camber must be imparted to the truss to prevent the truss from sagging when supporting a load. Camber is imparted to the truss by arching the truss so that the top chord is bowed slightly away from the bottom chord and the bottom chord is bowed slightly toward the top chord to counteract the tendency of the truss to sag in the opposite direction at the center of the truss's span when a load is placed on the top chord.

DESCRIPTION OF THE PRIOR ART

According to prior practice, wood trusses may be fabricated by placing the top and bottom chords in position on a movable support surface, such as a truss assembly jig, and by attaching the vertical connector members and web members between the chords with corrugated fasteners or nails to hold the vertical connector members and web members in position. Stop members are typically positioned in contact with the top and bottom chords along the respective outer surfaces thereof to hold the truss members securely in position on the moveable surface of the jig.

A first set of connector plates is placed over the joints at which the vertical connector members and web members intersect the top and bottom chords on the upwardly facing surface of the truss and tapped so that the teeth of the connector plates are slightly embedded into the wood to hold them in place. A lifting device is then used to raise the truss from the support surface sufficiently to place a second set of connector plates under the truss on the joints on the downwardly facing surface of the truss at substantially the same locations as on the upwardly facing surface thereof. At this stage, connector plates are positioned on the truss joints on both the upwardly and downwardly facing surfaces thereof, with the second set of connector plates positioned between the downwardly facing surface of the truss and the moveable support surface.

The truss is then carried by the support surface into one or more pressing stations, which are comprised of one or more pairs of pressing rollers, whereby the connector plates are embedded into the wooden members at the truss joints as the truss is passed between each pair of rollers. Camber is typically imparted to the truss by a plurality of camber rollers positioned downstream of the first pressing station.

Apparatus and methods known in the art for fabricating wood trusses have several disadvantages and limitations. One problem associated with such prior art apparatus and methods is that the first pair of pressing rollers typically has a substantially smaller diameter than the sets of pressing rollers located downstream. The first pair of pressing rollers is used to partially embed the teeth of the connector plates into the wood members of the truss. The relatively abrupt curvature of the roller surface, as compared to the larger diameter rollers located downstream, may impart a rocking motion to the connector plates, which prevents the teeth from being pressed straight into the wood members.

Another problem associated with such prior art truss assembly apparatus and methods is the problem of controlling the amount of camber applied to the truss. It is often difficult to produce a consistent, predetermined camber because of the difficulty in properly positioning the camber roller and in maintaining the camber rollers in position. The mechanism used to position the camber rollers is subjected to large mechanical stresses when the truss is being cambered, which may result in slippage and free play in the camber roller positioning mechanism.

Still another problem associated with prior art apparatus and methods of fabricating trusses is the problem of maintaining the truss in proper alignment as the truss passes through the various stages of pressing rollers and through the camber rollers. In order to securely attach the connector plates, the truss must be moved from the support surface of the jig before the truss enters the final pressing station. Misalignment of the truss as it passes through the final pressing station causes critical errors in the fabrication of the truss.

OBJECTS OF THE INVENTION

It is therefore the principal object of the present invention to provide an improved apparatus for fabricating wood trusses.

Another object of the invention is to provide an improved apparatus for imparting camber to a wood truss.

Still another object of the invention is to provide an apparatus for enhancing the precision and consistency of the camber imparted to a wood truss.

SUMMARY OF THE INVENTION

These and other objects are accomplished in accordance with the present invention wherein an apparatus for imparting camber to a truss having oppositely positioned top and bottom chords and a plurality of web members interconnecting the chords includes a conveyor surface for supporting the truss and means for moving the conveyor surface and truss in a predetermined direction. Means for imparting a predetermined camber to the truss is located with respect to the conveyor surface.

In accordance with one feature of the invention, the cambering means includes an elongated member pivotally mounted on one side of the apparatus and having first and second spaced apart camber rollers mounted thereon so that the first and second camber rollers can be positioned out of alignment with respect to an axis which is parallel to the predetermined direction and can engage the top chord of the truss. Third and fourth spaced apart camber rollers are positioned on an opposite side of the apparatus for engaging the bottom chord of the truss. The third and fourth camber rollers are maintained substantially in alignment along an axis which is parallel to the predetermined direction. Means is provided for adjusting the position of the third and fourth camber rollers laterally with respect to the predetermined direction so that the third and fourth camber rollers are movably substantially in unison in each direction along the lateral axis.

In one embodiment, the means for adjusting the position of the third and fourth camber rollers includes first and second spaced apart vertical arms, each of which has a threaded sleeve at each end thereof. The third camber roller is mounted on the first vertical arm and the fourth camber roller is mounted on the second vertical arm. First and second cooperating pairs of threaded shafts extend laterally with respect to the predetermined direction. The individual shafts of the first cooperating pair extend through corresponding sleeves on the first vertical arm so that the shaft threads engage complementary threads in the corresponding sleeves. By the same token, the individual shafts in the second cooperating pair extend through corresponding sleeves in the second vertical arms so that the shaft threads engage complementary threads in the corresponding sleeves. Means is provided for rotating the first and second cooperating pairs of shafts in unison so that the engagement between the shaft threads and the threads of the corresponding sleeves results in the movement of the first and second vertical arms and the corresponding third and fourth camber rollers laterally along the corresponding shafts. The direction of rotation of the shafts determines the direction of lateral movement of the first and second vertical arms and of the third and fourth camber rollers.

In another embodiment, the elongated member includes an arm member which can be pivoted from a predetermined position at which the arm member is substantially parallel to the predetermined direction. The first and second camber rollers are mounted on one side of the arm member for contacting the top chord of the truss. In accordance with another aspect of the invention, means is provided for engaging an opposite side of the arm member to prevent the arm member from pivoting back toward the predetermined position after the arm member has been pivoted away therefrom, thereby counteracting torque exerted on the arm member by the truss tending to bend the arm member back toward the predetermined position. The first and second camber rollers cooperate with the third and fourth camber rollers to impart a predetermined amount of camber to the truss.

BRIEF DESCRIPTION OF THE DRAWINGS

Further objects and advantages of the invention will be apparent from the detailed description and claims when read in conjunction with the accompanying drawings wherein:

DETAILED DESCRIPTION OF THE PREFERRED EMBODIMENT

Figure 1:
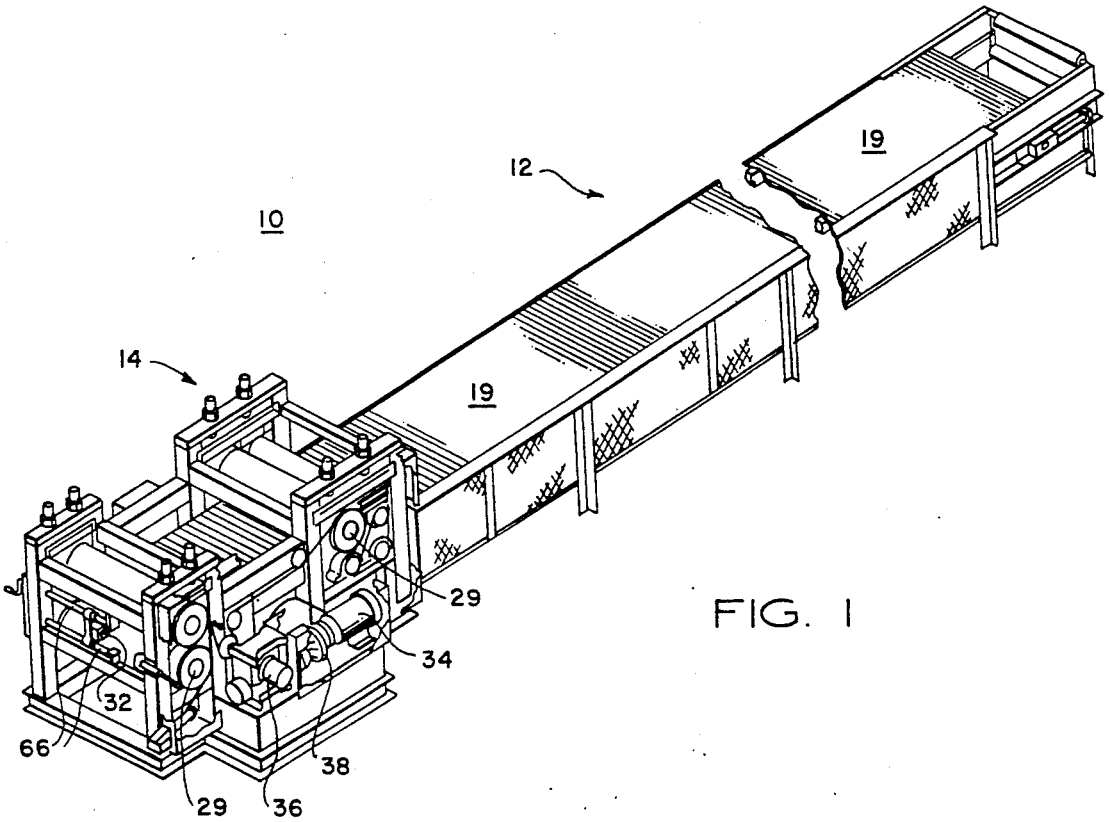
FIG. 1 is a perspective view of an apparatus for fabricating a wood truss in accordance with the present invention.

In the description which follows like parts are marked throughout the specification and drawings, respectively. The drawings are not necessarily to scale and in some instances proportions have been exaggerated in order to more clearly depict certain features of the invention.

Referring to FIGS. 1, 2, 3A and 4, an apparatus 10 for fabricating wood trusses in accordance with the present invention is comprised of a table section 12 and a head section 14. Table section 12 includes a motor-driven conveyor, which is preferably comprised of a pair of parallel, continuous loop chain and sprocket drives 16A and 16B, which are attached to the respective undersurfaces of a plurality of parallel steel slats 18, which define conveyor surface 19 of table section 12. Selected ones of slats 18 have a plurality of pre-drilled threaded holes (not shown) therein for positioning a plurality of tooling blocks (as will be described in greater detail hereinafter with reference to FIG. 9) on the corresponding top surfaces thereof for anchoring the chords of the truss while the web members and vertical connector members are placed therebetween. The actual placement to the tooling blocks is adjusted to fit the dimensions of the truss being assembled.

Head section 14 has a first pressing station with first and second pairs of press rollers 20 and 22, respectively, for partially embedding the connector plates into the truss members as the truss passes between each pair of rollers 20 and 22. Roller pairs 20 and 22 are comprised of respective top rollers 20A and 22A and bottom rollers 20B and 22B for exerting a pressing force in a direction which is substantially perpendicular to the plane of movable conveyor surface 19. Top rollers 20A and 22A are independently adjustable along a vertical axis to adjust the spacing between each top roller 20A and 22A and its corresponding bottom roller 20B and 22B to conform to the thickness of the truss being fabricated. The vertical adjustment of top rollers 20A and 22A is accomplished in a conventional manner, such as by means of a screw-operated adjustment mechanism, as described in U.S. Pat. No. 3,667,379, which description is incorporated by reference herein.

A second pressing station, located downstream of the first pressing station, includes a third pair of rollers 24, which is comprised of a corresponding top roller 24A and bottom roller 24B for completing the attachment of the connector plates to the truss members after the predetermined camber has been applied to the truss. The connector plates must be embedded into the truss by first and second sets of rollers 20 and 22 sufficiently to ensure that the plates are not dislodged during the cambering operation and yet not so much as to prevent the camber rollers from imparting the desired amount of camber to the truss. Camber is applied to the truss by means of four camber rollers 26, 28, 30 and 32. Camber rollers 26 and 28 engage the top chord of the truss and camber rollers 30 and 32 engage the bottom chord of the truss. The operation of the camber rollers will be described in greater detail hereinafter.

In one aspect of the invention, rollers 20A and 20B, 22A and 22B, and 24A and 24B all have substantially the same diameter. The sequential action by which the plates are embedded into the truss members is controlled by the vertical adjustment of the three top rollers 20A, 22A and 24A with respect to their corresponding bottom rollers 20B, 22B and 24B, as previously described. The diameter of each of these rollers is preferably as large as possible within the spatial constraints of head section 14. The larger diameter rollers tend to press the connector plates into the truss members much straighter than when smaller diameter rollers are used because of the more gradual curvature of the surface of the larger diameter rollers, which reduces the rocking action on the upstream and downstream ends of the connector plates. A roller diameter on the order of 10 inches is usually adequate.

Figure 3A:
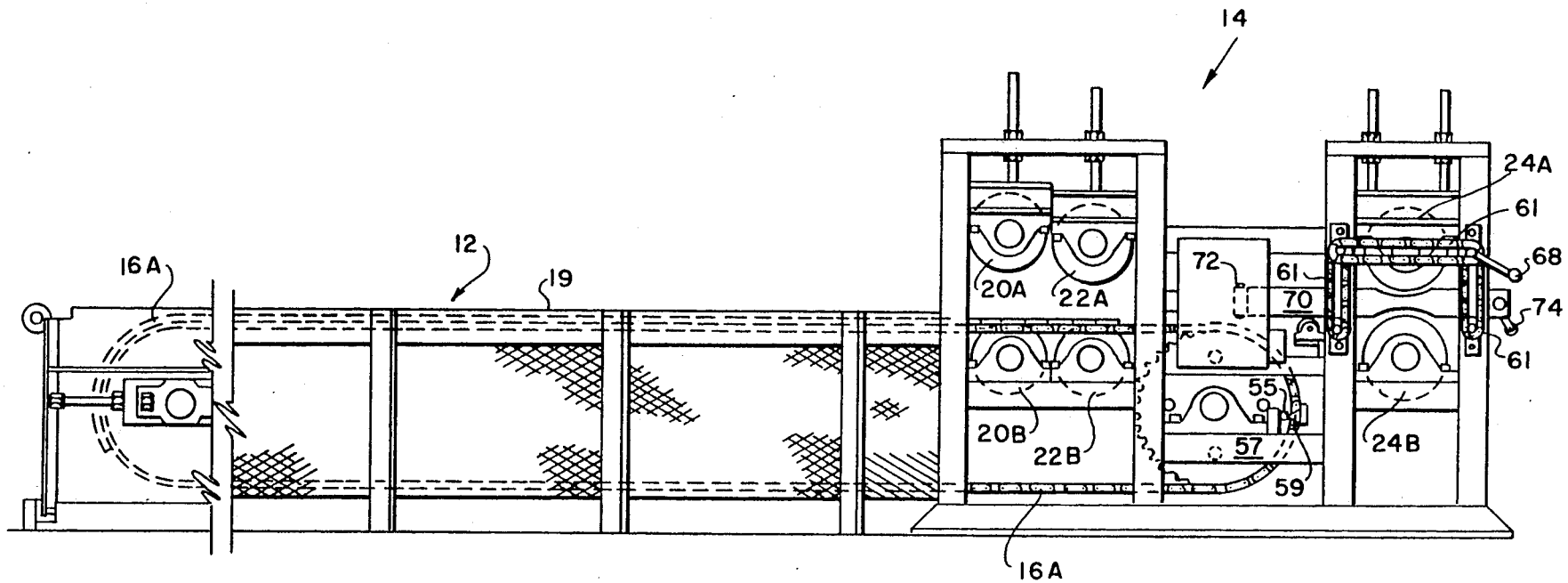
FIG. 3A is a side elevation view of a first embodiment of the apparatus according to the present invention.
Figure 3B:
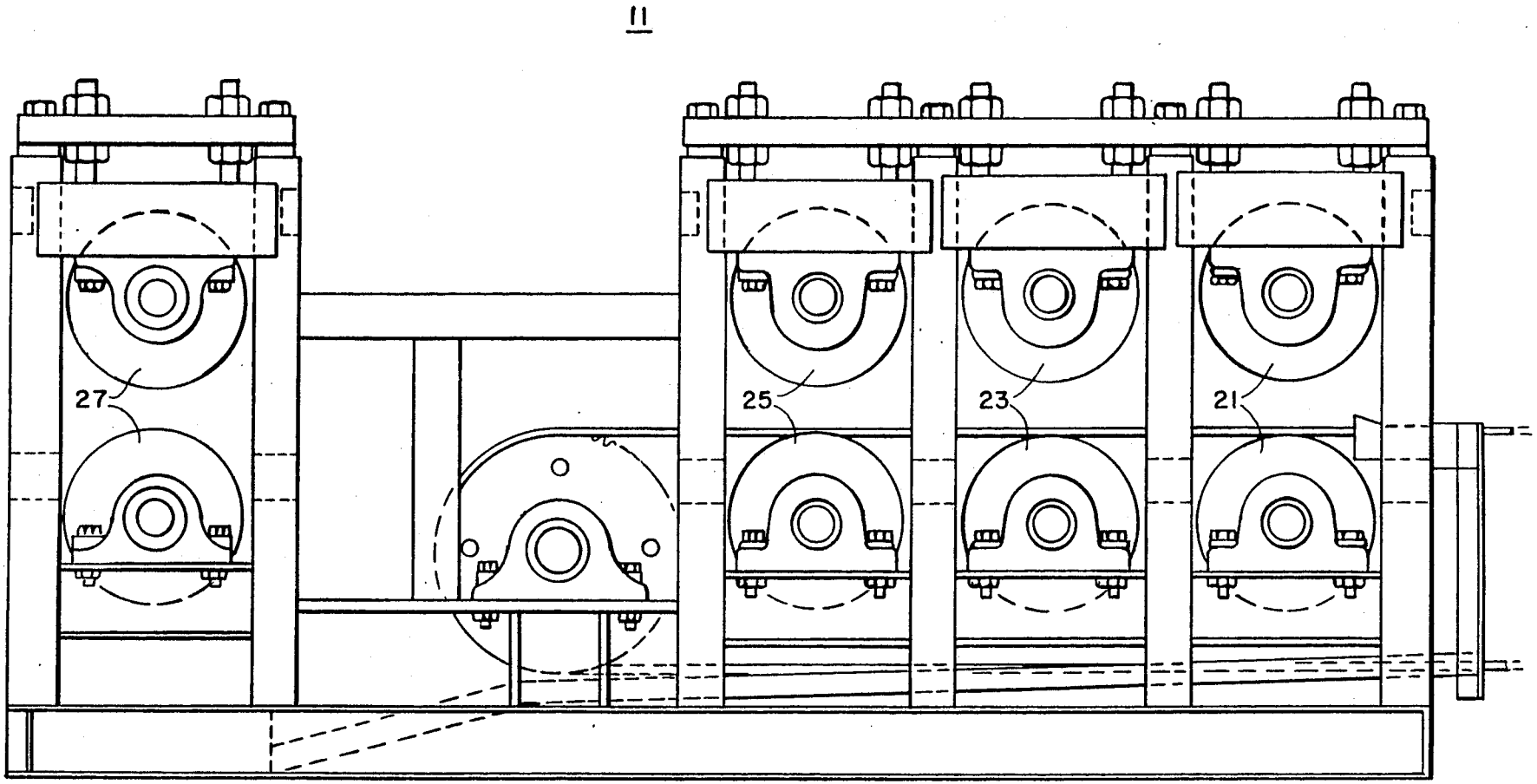
FIG. 3B is a side elevation view of a portion of a second embodiment of the apparatus.

Referring to FIG. 3B, an alternate embodiment of an apparatus 11 for fabricating wood trusses has three pairs of rollers 21, 23 and 25 in the first pressing station instead of two pairs. A fourth pair of rollers 27 is positioned in the second pressing station. All of the rollers comprising first, second, third and fourth pairs of rollers preferably have substantially the same diameter. The use of three pairs of rollers instead of two in the first pressing station is advantageous when large, heavy duty trusses for commercial buildings are being fabricated because of the larger truss members and connector plates used, which require greater pressing forces to embed the connector plates.

Referring again to FIGS. 1, 2, 3A and 4, all three pairs of press rollers 20, 22 and 24 are driven by means of a common chain and sprocket drive arrangement 29, as best seen in FIG. 1, which is slaved to chain and sprocket drives 16A and 16B so that the press rollers are synchronously driven in connection with movable conveyor surface 19. The motive apparatus for the chain and sprocket drives associated with movable conveyor surface 19 and roller sets 20, 22 and 24 is provided by an electric motor 34, which turns the aforementioned chain and sprocket drives through a reduction gear 36. An air clutch 38 is interposed between motor 34 and reduction gear 36 to provide a smooth startup for apparatus 10 so the connector plates positioned between the truss and the top surface of slats 18 do not slip during start up.

Figure 8:
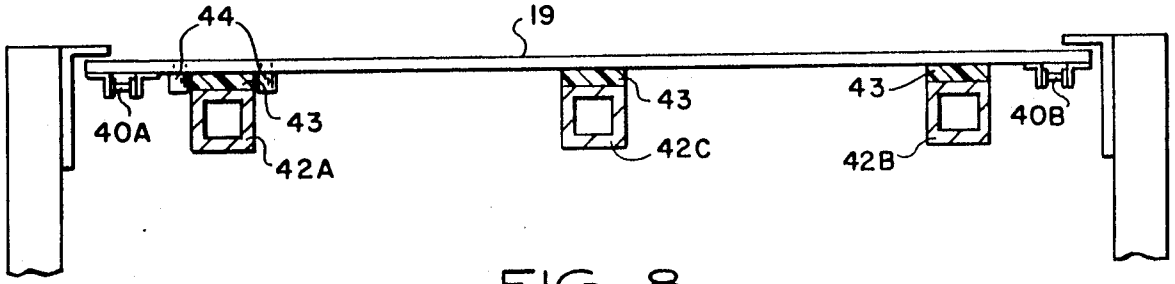
FIG. 8 is an end elevation view, illustrating three guide rails beneath the movable support surface of the apparatus.

Referring also to FIG. 8, each slat 18 is attached to drive chains 40A and 40B comprising chain and sprocket drives 16A and 16B at respective opposite ends of each slat. Three elongated guide rails 42A, 42B and 42C are disposed beneath slats 18 for maintaining the alignment of slats 18 along a predetermined downstream direction when apparatus 10 is being operated so as to move the truss members along table section 12 and into head section 14 in proper position. Selected ones of slats 18 have a pair of guide rollers 44 positioned on an undersurface thereof for contacting respective opposite sides of outer guide rail 42A to keep each slat 18 in proper alignment. Each guide rail 42A, 42B and 42C has a low friction material 43 disposed thereon to facilitate the sliding action of slats 18 along guide rails 42A, 42B and 42C. Low friction material 43 is preferably comprised of UHMW (ultra-high molecular weight) polyethylene material.

Figure 13:
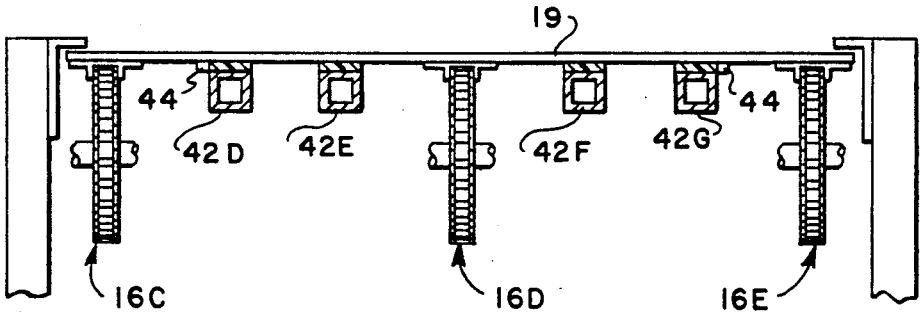
FIG. 13 is an end elevation view, illustrating three chain drives and four guide rails beneath the movable support surface of the apparatus.

In another aspect of the invention center guide rail 42C is added to outside rails 42A and 42B to better support slats 18 and the truss members being carried thereon. The addition of center guide rail 42C prevents sagging at the center of movable conveyor surface 19, which can lead to deformation of the truss and improper positioning thereof as the truss enters head section 14. In another embodiment, as shown in FIG. 13, four guide rails 42D, 42E, 42F and 42G are provided for supporting conveyor surface 19, such that there are two outside rails and two inside rails. A guide roller 44 is positioned in contact with the outside surface of each of the two outside rails 42D and 42G, to guide the slats along the rails. Three chain and drive mechanisms 16C, 16D and 16E are positioned as shown in FIG. 13, with guide rails 42D and 42E positioned between chain and drive mechanisms 16C and 16D and guide rails 42F and 42G positioned between chain and drive mechanisms 16D and 16E, to increase the driving force imparted to the conveyor. This configuration is well-suited for the fabrication of heavy duty trusses for commercial application.

Figure 2:
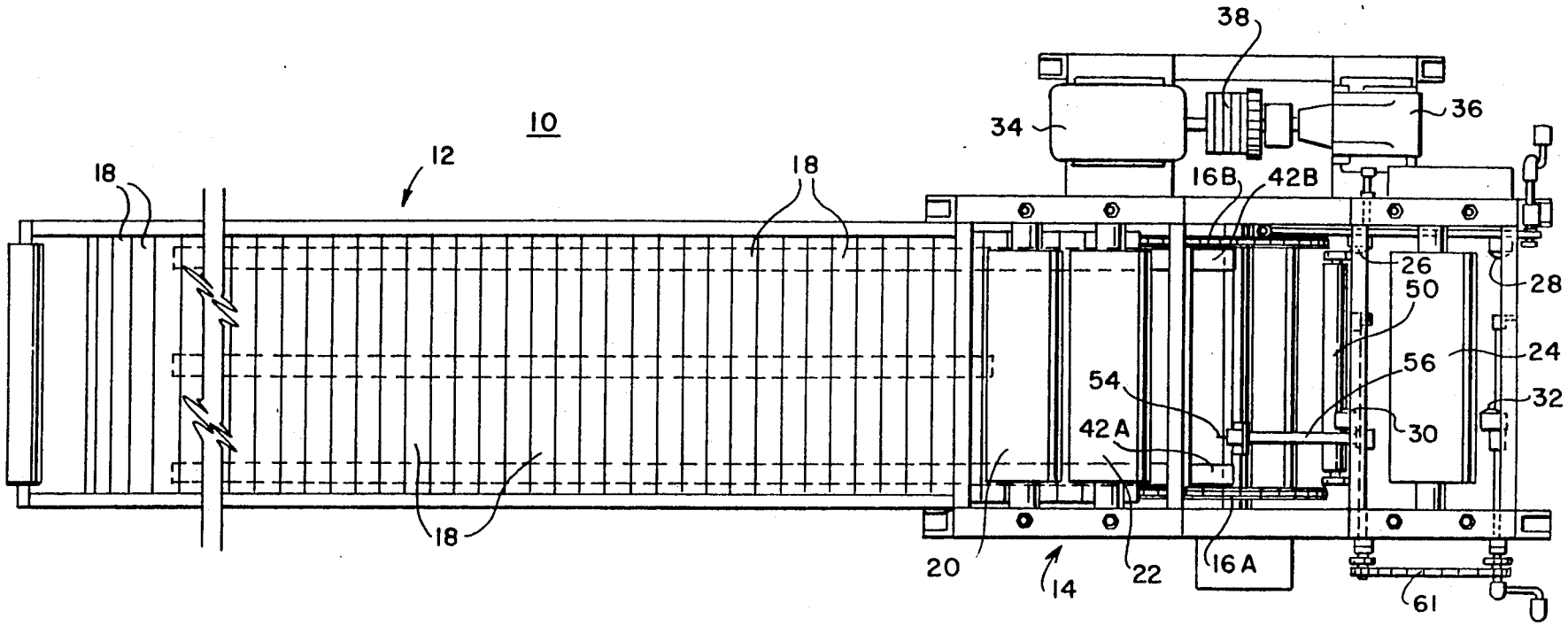
FIG. 2 is a top plan view of the apparatus of FIG. 1, emphasizing selected portions of the apparatus.
Figure 5:
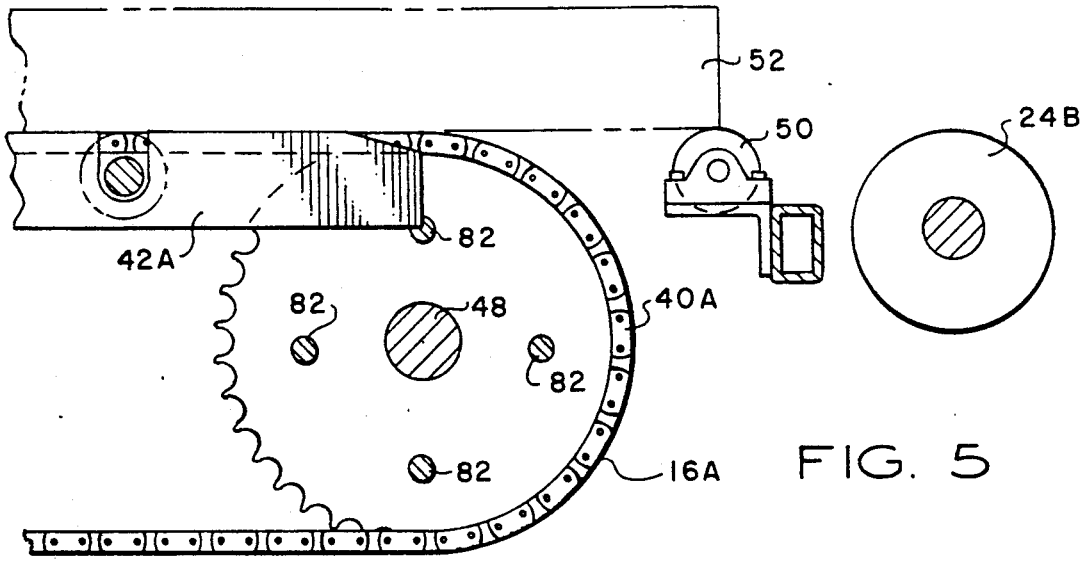
FIG. 5 is a side elevation view of a portion of the apparatus, illustrating means for lifting the truss as it passes through the pressing stations in the apparatus.

In yet another aspect of the invention, as best seen in FIGS. 2 and 5, outer guide rails 42A and 42B are extended beyond the first pressing station in head section 14 in order to maintain conveyor surface 19 in proper alignment as the connector plates are being partially embedded into the truss members in head section 14. As best seen in FIG. 5, outer guide rails 42A and 42B extend to a position which is substantially coterminous with drive shaft 48 at the downstream end of chain and sprocket drives 16A and 16B, although only guide rail 42A and chain and sprocket drive 16A are depicted in FIG. 5. It is at this location that chain and sprocket drive 16A and, of course, chain and sprocket drive 16B on the opposite side, make a U-turn at the downstream end of the continuous loop chain and sprocket drives. An elongated roller 50 is positioned at the inlet to the second pressing station and beneath camber rollers 26 and 30 for lifting truss 52 upwardly so that the truss 52 clears lower press roller 248 as truss 52 continues its downstream movement. Lifting roller 50 preferably spans substantially the entire width of apparatus 10.

Figure 7:
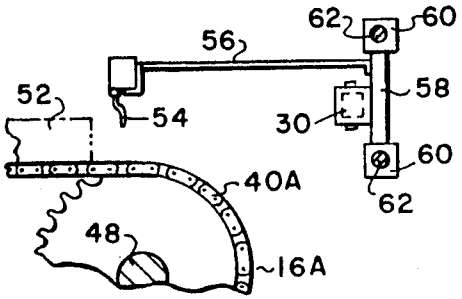
FIG. 7 is a side elevation view, illustrating the positioning of a cut-off switch for stopping the operation of the apparatus when the truss is out of alignment.

Referring to FIGS. 2 and 7, an electrical cut-off switch 54 is positioned downstream of chain and sprocket drives 16A and 16B at the inlet to the second pressing station. Switch 54 is mounted on an elongated bar 56, which is in turn attached to an arm 58 on which camber roller 30 is mounted. Arm 58 has a pair of threaded sleeves 60 disposed at respective opposite ends thereof for engaging complementary threads on a pair of parallel shafts 62, which extend laterally with respect to the direction of movement of truss 52. Camber roller 32 is mounted in substantially the same manner on arm 64, which engages a corresponding pair of parallel shafts 66.

Figure 12:
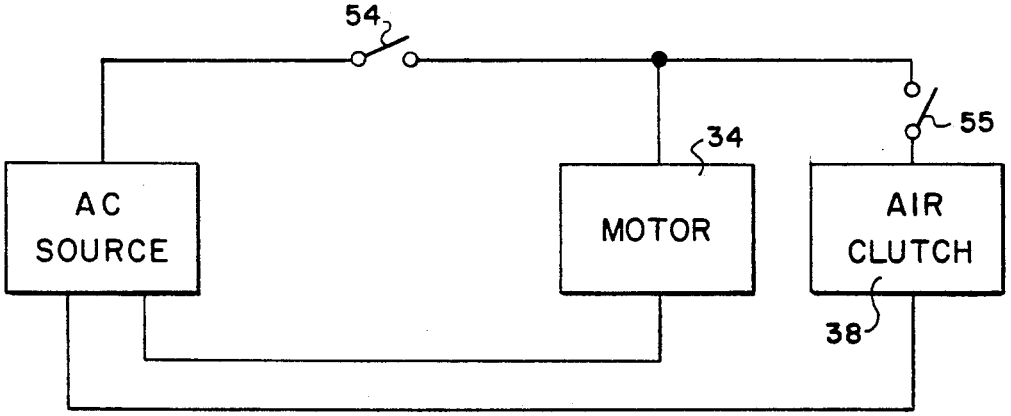
FIG. 12 is a circuit diagram illustrating means for selectively enabling and disabling the apparatus.

Camber rollers 30 and 32 are positioned in contact with the bottom chord of truss 52. The position of camber rollers 30 and 32 is adjusted laterally with respect to the axis of movement of truss 52 to conform to the width dimensions of the truss being fabricated. As camber roller 30 is moved laterally, cut-off switch 54 is also moved laterally so that the position of cut-off switch 54 is adjusted in accordance with the width of truss 52. If truss 52 is out of alignment as it moves past the downstream end of conveyor surface 19, truss 52 will contact switch 54, which automatically disables motor 34 and air clutch 38 and stops the operation of apparatus 10, as shown in FIG. 12. Motor 34 must be restarted and then air clutch 38 before apparatus 10 can be reactivated. An emergency stop cable extends around the perimeter of the entire apparatus 10 and associated machinery to disable motor 34 and air clutch 38 when the cable is pulled. Apparatus 10 cannot be reactivated until motor 34 is first restarted and then air clutch 38.

Referring also to FIG. 3A, a limit switch 55 is mounted on frame 57 for engaging a projection 59 mounted on a particular slat 18 to temporarily disable apparatus 10 when switch 55 is open. Switch 55 is normally in a closed position, but is open when projection 59 engages switch 55. Projection 59 includes a cam member, which engages a cam roller attached to switch 55 to open switch 55. As shown in FIG. 12, air clutch 38, but not motor 34, is disabled when switch 55 is open. In this manner apparatus 10 is temporarily disabled after each truss fabrication cycle to allow the operators to position the truss components on conveyor surface 19 for the next fabrication cycle. Thus, apparatus 10 will be started from and stopped at substantially the same position for each cycle. Keeping motor 34 running decreases the time required between cycles by eliminating the delays associated with motor start-up.

Figure 4:
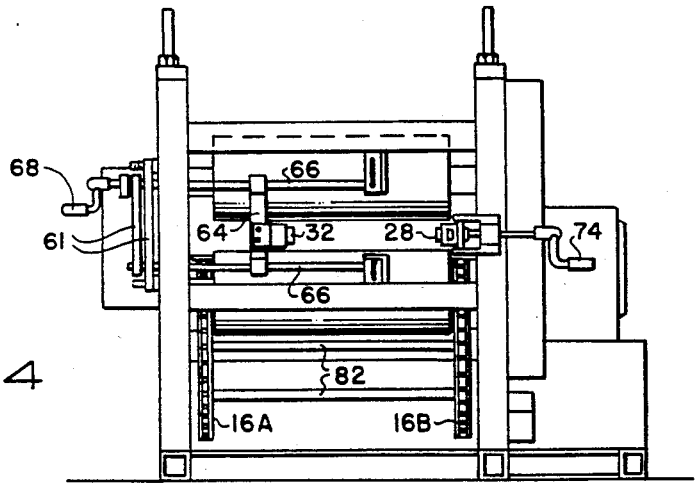
FIG. 4 is an end elevation view of the apparatus according to the present invention, viewed from the discharge or downstream end of the apparatus.

Referring specifically to FIGS. 2, 3A and 4, camber rollers 30 and 32 are movable laterally with respect with the axis of movement of truss 52 by means of a common adjustment device. Each pair of threaded shafts 62 and 66 is mechanically slaved together by means of a common chain and sprocket mechanism 61, as best seen in FIGS. 2 and 3A. Chain and sprocket mechanism 61 is operated by means of a handle 68. The direction in which handle 68 is turned determines the direction of rotation of chain and sprocket mechanism 61, which in turn determines the direction of rotation of threaded shafts 62 and 66, thereby causing arms 58 and 64 and their respective camber rollers 30 and 32 to move in the desired direction laterally with respect to the axis of movement of truss 52. In this manner camber rollers 30 and 32, which contact the bottom chord of truss 52, are adjusted together in a single step operation, which facilitates the adjustment process and enhances the positioning accuracy of camber rollers 30 and 32.

Figure 6:
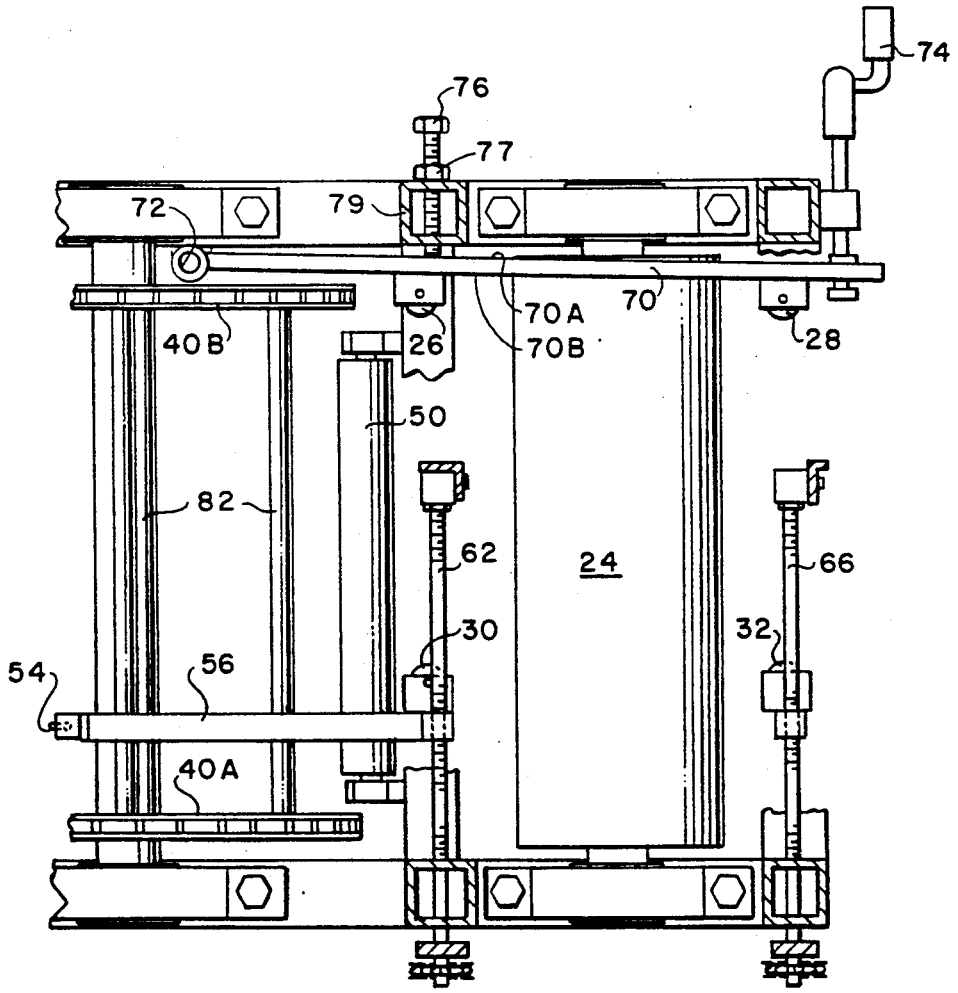
FIG. 6 is a top plan, partial cutaway view, illustrating the mechanism by which selected ones of the camber rollers are positioned to impart predetermined camber to the truss.

Referring to FIGS. 2 and 6, camber rollers 26 and 28, which contact the top chord of truss 52, are mounted on a pivot arm 70 which pivots about a vertical axis passing through a position indicated at 72. A crank handle 74 is turned to adjust the position of pivot arm 70. The more that camber roller 28 is moved out of alignment with camber roller 26, the greater will be the camber imparted to truss 52. To prevent slippage of pivot arm 70, which can result in errors in the truss camber, and to mechanically strengthen pivot arm 70 and hold it in a fixed position, a stabilizer bolt 76 is positioned in contact with back surface 70A of pivot arm 70, which is opposite from front surface 70B of pivot arm 70 on which camber rollers 26 and 28 are mounted. Bolt 76 is adjusted snug against back surface 70A of pivot arm 70 to counteract the torque which tends to bend pivot arm 70 away from truss 52 when camber is being imparted thereto. A nut 77 holds bolt 76 in position in housing 79, which has aligned threaded openings for receiving bolt 76 and engaging complementary threads on bolt 76.

Figure 9:
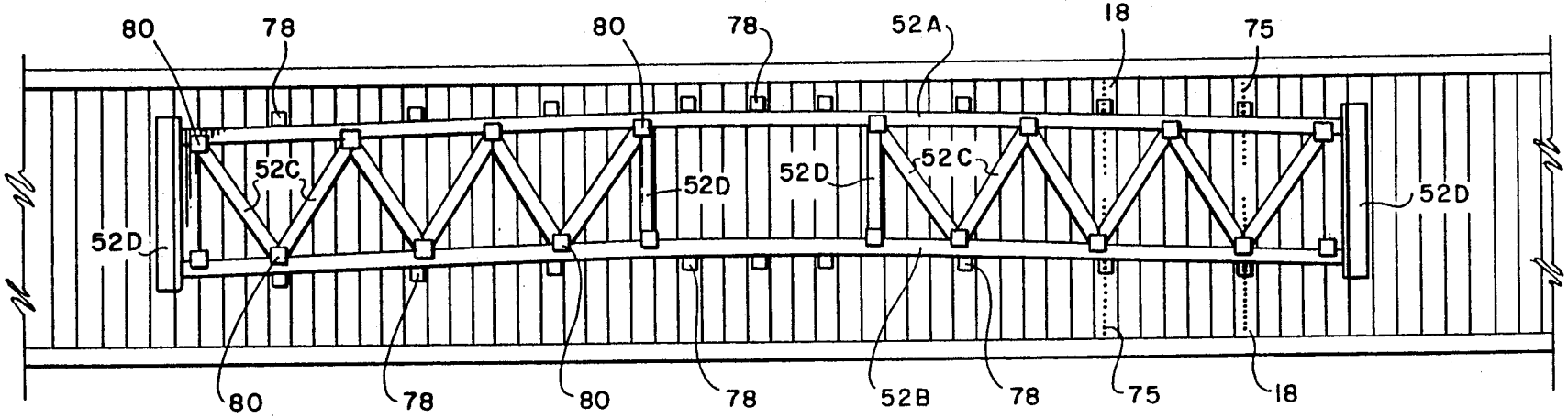
FIG. 9 is a top plan view of the table section of the apparatus on which the truss members are disposed, illustrating the means by which camber is imparted to the truss prior to the attachment of the metal connector plates.

Referring to FIG. 9, an alternate embodiment for imparting camber to truss 52 is depicted. As previously mentioned, selected one of slats 18 have a plurality of pre-drilled threaded holes 75 at selected positions along corresponding slats 18 for receiving corresponding tooling blocks 78, which are used to hold the truss members in position during the fabrication process. Holes 75 are positioned at intervals of approximately on and one-half inches along the corresponding slats 18. Individual slats 18 having holes 75 are arranged at approximately two foot intervals along the axis of movement of conveyor surface 19. Each tooling block 78 has a series of holes on the base portion thereof at intervals of approximately three-fourths of an inch. Each block 78 is affixed to a corresponding slat 18 by positioning two of the holes in block 78 in registration with a selected pair of holes 75 on the corresponding slat 18 and by bolting block 78 to the corresponding slat 18. The positions of blocks 78 may be adjusted in increments of approximately one-half inch. Tooling blocks 78 are positioned to define the desired lines along which truss 52 is to be cambered. Top chord 52A, bottom chord 52B, web members 52C and vertical members 52D are forced into position between fixed blocks 78 to form the outline of truss 52. Connector plates 80 are positioned over the truss joints both above and below truss 52, as previously described. At this juncture, connector plates 80 have not yet been embedded into the truss joints so that less force is required to impart camber to truss 52 than when camber rollers are used in the second pressing station after connector plates 80 have been partially embedded into truss 52. Tooling blocks 78 hold the truss members in position to maintain the desired amount of camber as truss 52 is moved through the first and second pressing stations in which connector plates 80 are fully embedded into truss 52, thereby eliminating the need for camber rollers in the second pressing station.

Figure 10:
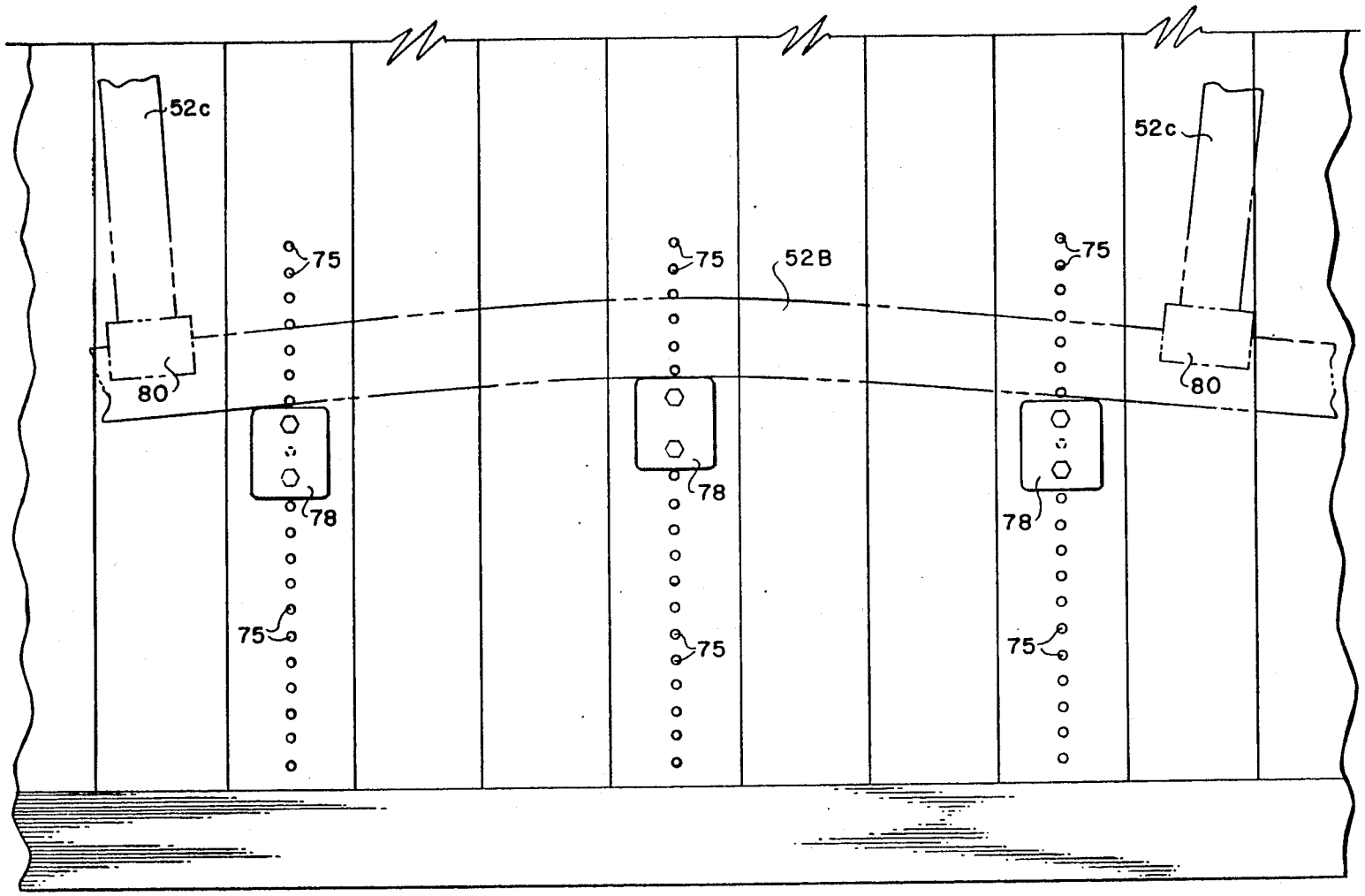
FIG. 10 is a top plan view detailing a portion of the apparatus and truss depicted in FIG. 9.

Referring to FIG. 10, holes 75 on each slat 18 are preferably offset slightly, along an axis which is transverse relative to the movement of conveyor surface 19, with respect to the corresponding holes 75 on adjacent slats 18 so that imaginary line segments connecting corresponding holes 18 on adjacent slats 18 approximate a curve representing the desired amount of camber of truss 52. Holes 75 are pre-drilled to specifications depending upon the desired camber. For example, if the desired amount of camber is such that the center of each truss chord is displaced approximately three-fourths of an inch from an axis connecting the ends of the truss for each 40 foot span of truss (a radius of curvature of approximately 3,200 feet), holes 75 are predrilled so that the top and bottom chords will be bent to define that approximate arc when the chords are positioned between tooling blocks 78. FIG. 10 illustrates the central portion of bottom chord 52B, which is bent by tooling blocks 78 to impart the desired amount of camber. Although not shown in FIG. 10, the top chord is also cambered the same amount as bottom chord 52B by corresponding tooling blocks positioned to define the desired camber arc. It is easier to impart the camber before the connector plates are embedded, particularly when heavy duty trusses, which may be comprised of 4×4 or even larger chords, are being fabricated. Blocks 78 are mounted in the corresponding holes 75 in accordance with the width of the truss (i.e., the distance between the respective outer surfaces of the top and bottom chords).

Figure 11:
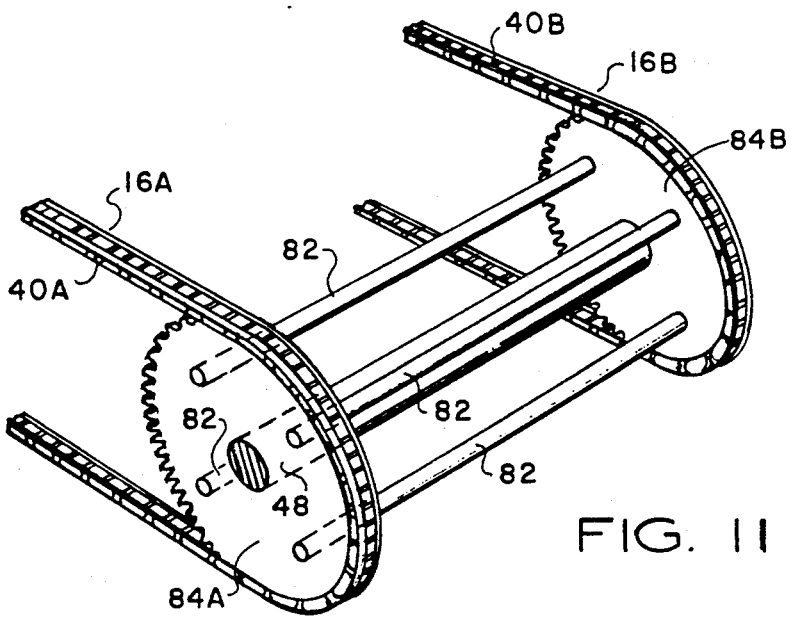
FIG. 11 is a perspective view of a portion of a chain and sprocket drive system for the apparatus.

Referring to FIG. 11, four elongated rigid bars 82 are attached at their respective opposite ends to the facing major surfaces of sprockets 84A and 84B at both ends of chain and sprocket drives 16A and 16B in order to stabilize sprockets 84A and 84B and prevent the sprockets from wobbling during operation. Although only the downstream ends of chain and sprocket drives 16A and 16B are shown, one skilled in the art will appreciate that the two sprockets at the upstream ends of drives 16A and 168 also have four stabilizer bars 82 extending therebetween. Bars 82 are disposed at substantially equal angular intervals around central drive shaft 48 connecting sprockets 84A and 84B.

Various embodiments of the invention have now been described in detail. Since it is obvious that changes in and additions to the above-described preferred embodiment may be made without departing from the nature, spirit and scope of the invention, the invention is not to be limited to said details, except as set forth in the appended claims.

What is claimed is:

1. Apparatus for imparting camber to a wood truss, said truss being comprised of oppositely positioned top and bottom chords and a plurality of web members interconnecting the top and bottom chords, said apparatus comprising:

a relatively flat conveyor surface for supporting said truss;

means for moving said truss in a predetermined direction;

an arm member pivotally mounted on one side of said apparatus;

first and second spaced apart camber rollers mounted on one side of said arm member for contacting the top chord of the truss, said first and second camber rollers being movable out of alignment with respect to an axis which is parallel to the predetermined direction when said arm member is pivoted from a predetermined position at which said arm member is substantially parallel to the predetermined direction;

third and fourth spaced apart camber rollers positioned on an opposite side of said apparatus for contacting the bottom chord of the truss, said third and fourth camber rollers being maintained substantially in alignment along an axis which is parallel to the predetermined direction, said third and fourth camber rollers for cooperating with said first and second camber rollers to impart a predetermined amount of camber to the truss, the amount of displacement of said arm member from said predetermined position for determining the amount of camber imparted thereto;

adjustment means for selectively pivoting said arm member to position said arm member to impart a predetermined amount of camber to the truss; and means for engaging an opposite side of said arm member to prevent said arm member from pivoting back toward said predetermined position after said arm member has been pivoted away from said predetermined position, thereby counteracting torque exerted on said arm member by said truss tending to bend said arm member back toward said predetermined position.

2. The apparatus according claim 1 wherein said engagement means is comprised of a threaded member, one end of which engages the opposite side of the arm member, the rotation of said threaded member in a first direction for moving said threaded member toward the opposite side of said arm member to engage said opposite side thereof and prevent said arm member from being moved back toward said predetermined position, the rotation of said threaded member in a second direction, opposite from said first direction, for moving said threaded member away from the opposite side of said arm member to allow said arm member to be moved back toward said predetermined position.

3. The apparatus according to claim 2 wherein said threaded member engages said arm member at an intermediate position along the length thereof, said adjustment means being positioned adjacent to a free end of said arm member for cooperating with said threaded member to stabilize said arm member in a predetermined, fixed position.

4. The apparatus according to claim 3 wherein said third and fourth camber rollers are adjustable along an axis which is transverse with respect to the predetermined direction to conform to the width of the truss as measured along the transverse axis, said apparatus including means for coupling said third and fourth camber rollers so that said third and fourth camber rollers are adjustable substantially in unison.

5. Apparatus for imparting camber to a truss, said truss being comprised of oppositely positioned top and bottom chords and a plurality of web members interconnecting the chords, said apparatus comprising:

a conveyor surface for supporting said truss;

means for moving said conveyor surface in a predetermined direction;

an elongated member pivotally mounted on one side of the apparatus, said elongated member having first and second spaced apart camber rollers mounted thereon so that said first and second camber rollers can be positioned out of alignment with respect to an axis which is parallel to the predetermined direction, said first and second camber rollers for engaging the top chord of the truss;

third and fourth spaced apart camber rollers positioned on an opposite side of the apparatus for engaging the bottom chord of the truss, said third and fourth camber rollers for being maintained substantially in alignment along an axis which is parallel to the predetermined direction; and means for adjusting the position of the third and fourth camber rollers laterally with respect to the predetermined direction so that said third and fourth camber rollers are movable substantially in unison in each direction along said lateral axis.

6. The apparatus according to claim 5 wherein said means for adjusting the position of the third and fourth camber rollers is comprised of:

first and second spaced apart vertical arms, each of said vertical arms having a threaded sleeve at each end thereof, said third camber roller being mounted on said first vertical arm and said fourth camber roller being mounted on said second vertical arm;

first and second cooperating pairs of threaded shafts extending laterally with respect to the predetermined direction, the individual shafts of the first cooperating pair extending through corresponding sleeves on the first vertical arm so that the shaft threads engage complementary threads in the corresponding sleeves, the individual shafts of the second cooperating pair extending through corresponding sleeves on the second vertical arm so that the shaft threads engage complementary threads in the corresponding sleeves; and means for rotating the first and second cooperating pairs of shafts in unison so that the engagement between the shaft threads and the threads of the corresponding sleeves results in the movement of the first and second vertical arms and the corresponding third and fourth camber rollers laterally along the corresponding shafts, the direction of rotation of said shafts determining the direction of lateral movement of said first and second vertical arms.

7. The apparatus according to claim 6 wherein said means for rotating said shafts in unison is comprised of chain and sprocket means for mechanically coupling the first and second cooperating pairs of shafts and handle means for mechanically rotating said chain and sprocket means in a desired direction to rotate said cooperating pairs of shafts and adjust the position of said third and fourth camber rollers.

8. The apparatus according to claim 5 further including switch means positioned with respect to said conveyor surface for disabling operation of the apparatus when said switch means is activated by contact with said truss, said truss for contacting said switch means when said truss is out of alignment with respect to the predetermined direction.

9. The apparatus of claim 8 wherein said switch means includes a projection member which is positioned to contact said truss when said truss is out of alignment with respect to said predetermined direction.

10. The apparatus according to claim 8 wherein the position of said switch means is adjustable along an axis which is transverse with respect to the predetermined direction to conform to the width of the truss along said transverse axis.

11. The apparatus according to claim 10 wherein said switch means is coupled to said third camber roller so that the position of said switch means is adjustable along said transverse axis together with the adjustment of said third camber roller.

* * * * *